US009032656B2

(12) United States Patent
Lupher et al.

(10) Patent No.: US 9,032,656 B2
(45) Date of Patent: May 19, 2015

(54) TRIGGER ASSEMBLY AND METHOD OF OPTICAL DETECTION OF A TRIGGER ASSEMBLY STATE

(75) Inventors: John Hancock Lupher, Austin, TX (US); Hillman Lee Bailey, Dripping Springs, TX (US); Michael Eric Reimers, Austin, TX (US)

(73) Assignee: TrackingPoint, Inc., Pflugerville, TX (US)

( * ) Notice: Subject to any disclaimer, the term of this patent is extended or adjusted under 35 U.S.C. 154(b) by 0 days.

(21) Appl. No.: 13/351,220

(22) Filed: Jan. 16, 2012

(65) Prior Publication Data

US 2013/0180147 A1 Jul. 18, 2013

(51) Int. Cl.

| | |
|---|---|
| ***F41A 19/00*** | (2006.01) |
| ***F41A 17/48*** | (2006.01) |
| ***F41A 17/46*** | (2006.01) |
| ***F41A 19/58*** | (2006.01) |

(52) U.S. Cl.

CPC ..... *F41A 17/46* (2013.01); *F41A 19/58* (2013.01)

(58) Field of Classification Search

USPC ..... 42/1.01, 1.02, 1.03, 1.04, 1.05, 69.01, 42/69.02, 69.03, 70.01; 89/27.11, 28.05, 89/28.1, 28.2

See application file for complete search history.

(56) References Cited

U.S. PATENT DOCUMENTS

| | | | | | |
|---|---|---|---|---|---|
| 4,007,553 | A * | 2/1977 | Clegg | 42/1.01 |
| 4,476,644 | A * | 10/1984 | Laing | 42/70.01 |
| 5,303,494 | A * | 4/1994 | Tuma et al. | 42/70.04 |
| 5,465,518 | A * | 11/1995 | Blaser | 42/70.08 |
| 5,603,179 | A * | 2/1997 | Adams | 42/70.08 |
| 5,704,153 | A * | 1/1998 | Kaminski et al. | 42/70.11 |
| 6,301,815 | B1 * | 10/2001 | Sliwa | 42/70.01 |
| 6,343,429 | B1 * | 2/2002 | Mossberg et al. | 42/70.01 |
| 6,412,207 | B1 * | 7/2002 | Crye et al. | 42/70.06 |
| 6,442,880 | B1 * | 9/2002 | Allan | 42/70.08 |
| 6,481,140 | B1 * | 11/2002 | Marshall | 42/70.11 |
| 6,678,984 | B1 * | 1/2004 | Rapp et al. | 42/70.11 |
| 6,694,963 | B1 * | 2/2004 | Taylor | 124/32 |
| 6,823,621 | B2 * | 11/2004 | Gotfried | 42/70.06 |
| 6,826,000 | B2 * | 11/2004 | Lee et al. | 359/833 |
| 6,870,946 | B1 * | 3/2005 | Teng et al. | 382/124 |
| 6,917,695 | B2 * | 7/2005 | Teng et al. | 382/126 |
| 6,973,748 | B2 * | 12/2005 | Rice | 42/69.01 |
| 7,073,284 | B2 * | 7/2006 | Monks et al. | 42/69.01 |
| 7,076,903 | B2 * | 7/2006 | Edwards | 42/70.08 |
| 7,076,906 | B2 * | 7/2006 | Monks et al. | 42/84 |
| 7,089,697 | B2 * | 8/2006 | Monks | 42/69.01 |
| 7,661,218 | B2 * | 2/2010 | Pikielny | 42/70.01 |
| 7,866,307 | B2 * | 1/2011 | Monks | 124/32 |
| 8,132,349 | B1 * | 3/2012 | Huber | 42/69.02 |
| 8,215,048 | B2 * | 7/2012 | Summers | 42/85 |
| 2001/0032405 | A1 * | 10/2001 | Kaminski | 42/70.05 |
| 2003/0163942 | A1 * | 9/2003 | Herzog et al. | 42/70.07 |
| 2003/0221684 | A1 * | 12/2003 | Rice | 124/71 |

(Continued)

*Primary Examiner* — Bret Hayes
*Assistant Examiner* — Derrick Morgan
(74) *Attorney, Agent, or Firm* — Cesari & Reed LLP; R. Michael Reed

(57) ABSTRACT

A trigger assembly includes a plurality of components including a trigger shoe configured to disengage a firing mechanism in response to a force applied by a user. The trigger assembly further includes a first PCB having at least one optical sensor to receive light and a controller configured to determine a positional state of at least one of the trigger shoe and a selected one of the plurality of components in response to the light received by the at least one optical sensor.

17 Claims, 3 Drawing Sheets

(56) References Cited

U.S. PATENT DOCUMENTS

| | | | | |
|---|---|---|---|---|
| 2004/0200115 | A1* | 10/2004 | Monks et al. | 42/84 |
| 2006/0277808 | A1* | 12/2006 | Danner et al. | 42/70.09 |
| 2007/0074438 | A1* | 4/2007 | Parhofer et al. | 42/70.01 |
| 2007/0137091 | A1* | 6/2007 | Cross et al. | 42/142 |
| 2007/0245615 | A1* | 10/2007 | Karagias | 42/69.02 |
| 2008/0032268 | A1* | 2/2008 | Farrell et al. | 434/16 |
| 2008/0105243 | A1* | 5/2008 | Monks | 124/32 |
| 2010/0095574 | A1* | 4/2010 | Abst | 42/69.01 |
| 2010/0154766 | A1* | 6/2010 | Skilling | 124/71 |
| 2010/0170493 | A1* | 7/2010 | Sheng | 124/80 |
| 2010/0258101 | A1* | 10/2010 | Campo et al. | 124/51.1 |
| 2011/0061638 | A1* | 3/2011 | Kim | 124/80 |
| 2011/0139139 | A1* | 6/2011 | Knuth et al. | 124/77 |
| 2011/0226227 | A1* | 9/2011 | Douglas et al. | 124/77 |
| 2011/0232618 | A1* | 9/2011 | Gabrel | 124/73 |
| 2011/0259183 | A1* | 10/2011 | Compton et al. | 89/28.1 |
| 2011/0271574 | A1* | 11/2011 | Chang et al. | 42/70.06 |
| 2013/0019512 | A1* | 1/2013 | Kemmerer et al. | 42/70.05 |

* cited by examiner

TRIGGER ASSEMBLY AND METHOD OF OPTICAL DETECTION OF A TRIGGER ASSEMBLY STATE

FIELD

The present disclosure is generally related to trigger assemblies for use in small arms firearms, such as pistols and rifles.

BACKGROUND

Firearm firing mechanisms generally include a number of components that cooperate to hold a spring-loaded hammer or firing pin in a cocked position and then selectively release the hammer or firing pin, which applies force directly, or through an intermediate device, to an ammunition cartridge loaded within a chamber of the firearm. The components for holding a hammer or firing pin in a cocked position and then releasing the hammer or firing pin may be referred to as a trigger assembly.

Generally, the trigger assembly includes a trigger shoe that is accessible to the user to apply a pulling force. When the user pulls the trigger shoe with sufficient force to move the trigger shoe a pre-defined distance, the movement of the trigger shoe releases the spring-loaded hammer to fire the ammunition cartridge.

SUMMARY

In an embodiment, a trigger assembly includes a plurality of components including a trigger shoe configured to disengage a firing mechanism in response to a force applied by a user and includes a first circuit. The first circuit has at least one optical sensor and a controller configured to determine a positional state of at least one of the trigger shoe and a selected one of the plurality of components in response to light received by the optical sensor.

In another embodiment, a trigger assembly includes a trigger mechanism, a first circuit, a second circuit, and a controller. The trigger mechanism has a first side and a second side and includes a trigger shoe extending between the first and second sides. The trigger mechanism is configured to disengage a firing mechanism in response to a force applied to the trigger shoe. The first circuit is adjacent to the first side and includes a plurality of light-emitting diodes (LEDs) configured to transmit light through the trigger mechanism toward the second side. The second circuit is adjacent to the second side and includes a plurality of optical sensors corresponding to the plurality of LEDs. Each of the plurality of optical sensors is configured to produce an electrical signal proportional to light received from a respective one of the plurality of LEDs. The controller is configured to determine a state of the trigger mechanism based on electrical signals from the plurality of optical sensors.

In still another embodiment, a method includes directing light from a first side through a trigger mechanism using one or more light-emitting diodes (LEDs) and producing at least one electrical signal proportional to light received through the trigger mechanism by one or more optical sensors at a second side of the trigger mechanism opposite to the first side. The method further includes determining a state of the trigger mechanism based on at least one electrical signal.

BRIEF DESCRIPTION OF THE DRAWINGS

In the following discussion, the same reference numerals are used in the various illustrated examples to indicate the same or similar elements.

DETAILED DESCRIPTION OF ILLUSTRATIVE EMBODIMENTS

Embodiments of a trigger assembly are described below that can be utilized with small-arms firearms. The trigger assembly includes trigger components that are configured to release a firing mechanism in response to a force applied to a trigger shoe by a user and includes a circuit includes a sensor configured to detect a position of the trigger shoe. In one instance, the circuit includes a first printed circuit board (PCB) having light-emitting diodes (LEDs) positioned on a first side of the trigger components and a second PCB including optical sensors on a second (opposing) side of the trigger components. The LEDs are configured to emit light toward the second PCB and the optical sensors are configured to generate electrical signals proportional to the received light, which electrical signals indicate the relative positional state of one or more of the trigger components. In another instance, the sensor circuit can include, for example, one or more reed switches, lasers and laser detectors, proximity sensors, capacitive diaphragms, direct contact sensors, Hall effect sensors, or other sensors configured to detect the position of one or more components of the trigger assembly. For example, if a Hall effect sensor configuration were used, a magnet could be embedded within a portion of the trigger shoe, and a pair of sensors could be used to detect the strength of the magnetic field to determine the position of the trigger shoe.

This state information can be used by a control circuit. In one example, the control circuit may activate another circuit, such as a video camera, in response to optically detecting movement of the trigger shoe from a first position based on a change in the received light. In another instance, absence or presence of received light for an extended period by more than one optical sensor positioned adjacent to a component (such as a safety) may indicate that the safety mechanism is between states (i.e., not fully engaged), causing the controller to indicate an error condition, such as by providing a visual alert (such as illuminating an external LED), or to activate a blocking mechanism to prevent disengagement of the firing mechanism until the safety mechanism is fully engaged or disengaged. One possible example of a small-arms firearm that includes an embodiment of a trigger assembly system is described below with respect to FIG. 1.

Figure 1:
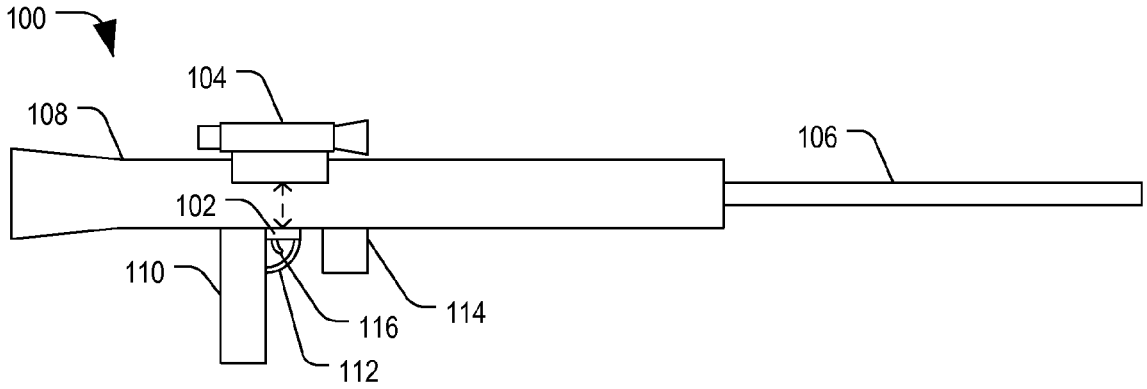
FIG. 1 is a side view of a firearm including a trigger assembly system with an optical detector for determining a state of a trigger assembly.

FIG. 1 is a side view of a firearm 100 including a trigger assembly system with a blocking mechanism. In the illustrated example, the firearm 100 is a rifle with a trigger assembly 102 coupled to a digital scope 104. Firearm 100 includes a barrel 106, a stock 108, a handle 110, a trigger guard 112, and a magazine 114. Trigger assembly 102 includes a trigger shoe 116 to which the user can apply force to discharge the firearm 100.

Digital scope 104 includes circuitry for communicating with trigger assembly 102 to determine a state of the trigger assembly. In particular, the circuitry within digital scope 104 can control one or more LEDs within trigger assembly 102 to emit light toward corresponding optical sensors on an opposing side of the trigger assembly 102, which optical sensors can communicate the received signals to the circuitry within digital scope 104. The LEDs can be aligned with openings internal to trigger assembly 102 that are aligned with components to detect displacement and/or positional information about the various components. In this manner, control circuitry 104 can determine optically whether a safety mechanism is engaged (or disengaged) and/or whether the trigger shoe 116 has been moved to disengage the firing mechanism.

In an example, control circuitry within digital scope 104 (or some other electronic device) may determine a state of trigger assembly 102 based on optical signals. The state may be used to provide information to a user, to record information into a storage log, or for a variety of other operations and functions, depending on the specific implementation. However, rather than relying solely on mechanical elements or vibrations to determine the state of the trigger assembly and the firing mechanism, control circuitry within digital scope 104 can also utilize sensor data to determine the state of the trigger assembly. An example of a system that includes LEDs and optical sensors for determining a state of a trigger mechanism is described below with respect to FIG. 2.

Figure 2:
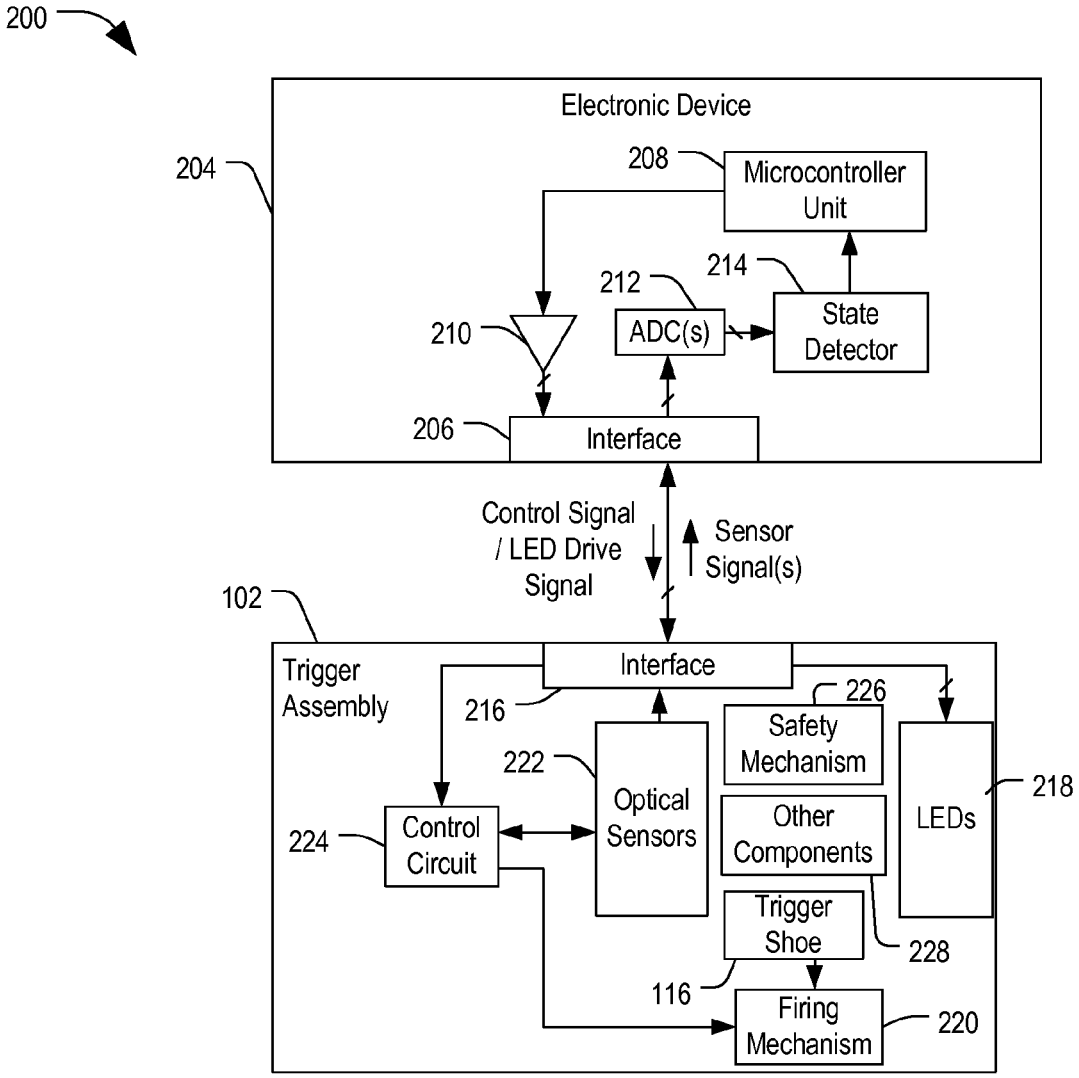
FIG. 2 is a block diagram of an embodiment of the trigger assembly system 200 including trigger assembly of FIG. 1 and an electronic device communicatively coupled to the trigger assembly.

FIG. 2 is a block diagram of an embodiment of the trigger assembly system 200 including trigger assembly 102 of FIG. 1 and an electronic device 204 communicatively coupled to the trigger assembly 102. Electronic device 204 can be a digital scope, an electronic safety device, or another electronic device configured to receive sensor signals from trigger assembly 102 and to communicate control signals to trigger assembly 102 through a wired or wireless connection.

Trigger assembly 102 includes trigger shoe 116 configured to translate a first force (a trigger force) to a firing mechanism 220 in response to a user-applied force. Trigger assembly 102 further includes an interface 216 configured to communicatively couple to electronic device 204. Interface 216 can be wired or wireless and configured for bi-directional communication with electronic device 204, such as to receive control signals and to send data. In an example, interface 216 includes pads or contacts for wired interconnection with a controller within electronic device 204. Interface 216 includes an output coupled to an input of a control circuit 224. Additionally, interface 216 includes an output coupled to one or more light-emitting diodes (LEDs) 218 and an input coupled to an output of one of more optical sensors 222. LEDs 218 and optical sensors 222 are positioned on opposing sides of trigger shoe 116, safety mechanism 226, and other components 228. LEDs 218 emit light toward optical sensors 222, and trigger shoe 116, safety mechanism 226, and other components 228 block the emitted light from optical sensors 222 in some instances and allow light to be received by optical sensors 222 in other instances, depending on the relative positions. In a particular example, force applied to trigger shoe 116 by a user causes trigger shoe 116 to move, causing one optical path through trigger shoe 116 to permit light to pass therethrough while another optical path through trigger shoe 116 blocks the light. Optical sensors 222 are configured to sense changes in the emitted light from LEDs 218. In particular, electrical signals produced by optical sensors 222 vary in proportion to the received light, thereby allowing state detector 214 to determine the positional state of selected components of trigger assembly 102.

Trigger assembly 102 further includes a firing mechanism 220 coupled to trigger shoe 116 and configured to disengage in response to force applied to trigger shoe 116. Firing mechanism 220 is also coupled to control circuit 224, which may include an actuator or other component to selectively control whether firing mechanism 220 can be disengaged in response to force applied to trigger shoe 116.

Electronic device 204 includes an interface 206 configured to couple to interface 216 within trigger assembly 102. Electronic device 204 further includes one or more analog-to-digital converters (ADC) having inputs coupled to interface 206 and outputs coupled to a state detector 214, which may be implemented as a state machine or other configurable logic. State detector 214 includes an output coupled to a micro controller unit (MCU) 208. In some instances, state detector 214 may be incorporated within MCU 208. Alternatively, state detector 214 can be omitted, and MCU 208 can be configured to determine the state of trigger assembly 102. MCU 208 includes an output coupled to an input of one or more drivers 210, which include outputs coupled to inputs of interface 206.

In an example, MCU 208 controls drivers 210 to provide LED drive signals to LEDs 218 through interfaces 206 and 216. LEDs 218 emit light toward optical sensors 222, which receive the emitted light based on the relative positions of trigger shoe 116, safety mechanism 226, and other components 228. Optical sensors 222 provide signals proportional to the received light to ADCs 212 through interfaces 216 and 206. ADCs 212 convert the signals into digital values, which are provided to state detector 214 to determine the state of trigger assembly 102. Such states can include an initial state, a transitional state, a trigger-pulled state, and an error state with respect to trigger shoe 116. Further, such states can include a safety "on" state or a safety "off" state with respect to safety mechanism 226. Such states may also include the states of other components of trigger assembly 102. In a particular instance, the states may include a blocked state and an unblocked state relative to a blocking mechanism, such as actuator 510 in FIGS. 5 and 6.

State detector 214 communicates the detected state of trigger assembly 102 to MCU 208, which can generate controls signals. In an example, in response to detecting the state of trigger assembly 102, MCU 208 generates control signals and sends them to control circuit 224 through interface 206 and interface 216 to control operation of firing mechanism 220 within trigger assembly 102.

While the above-discussion assumes an LED/optical sensor detection mechanism for determining the state of the trigger shoe 116, safety mechanism 226 and other components 228, as previously mentioned, it is also possible to utilize other types of detection circuits, including lasers and laser detectors, reed switches, proximity sensors, capacitive diaphragms, direct contact sensors, and so on. Regardless of the type of sensing mechanism used, the sensors should be arranged and configured to facilitate detection of the position of the particular component, and not just motion of the component. In an example, the sensing mechanism can detect that the trigger shoe is not in a first position and that it is in a second position. Thus, the sensing mechanism allows for determination of the component position, and not just motion.

While the example described above with respect to FIG. 2 includes the state detector and driver circuitry within electronic device 204, such circuitry may alternatively be provided within trigger assembly 102. An example of such an embodiment is described below with respect to FIG. 3.

Figure 3:
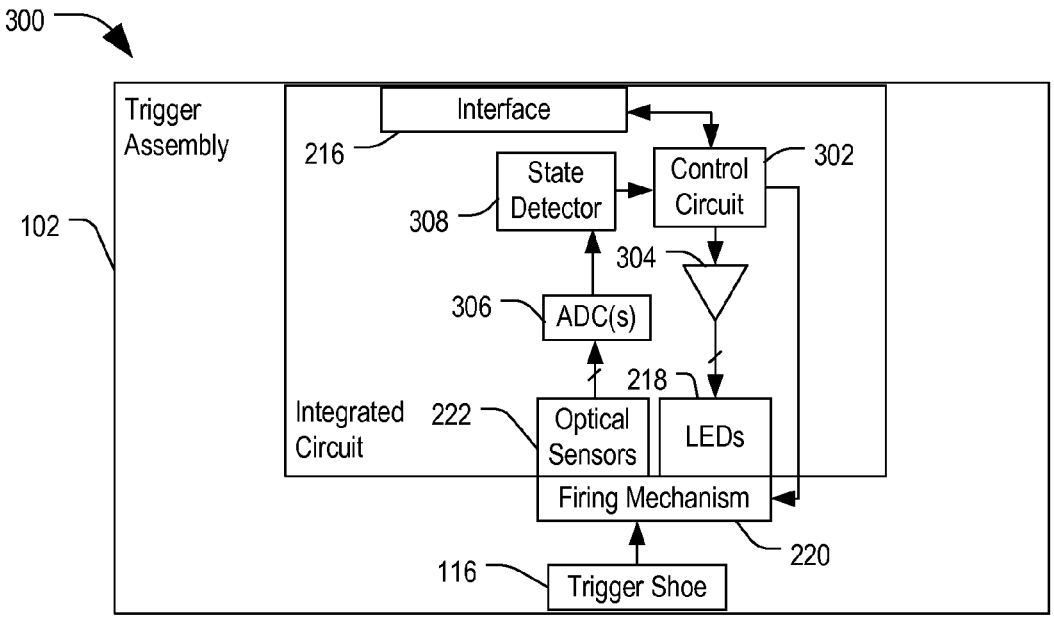
FIG. 3 is a block diagram of a second embodiment of a trigger assembly including light-emitting diodes (LEDs) and optical sensors for determining a state of the trigger assembly.

FIG. 3 is a block diagram of a second embodiment 300 of trigger assembly 102 including LEDs 218 and optical sensors 222 for determining a state of trigger assembly 102. In this example, trigger assembly 102 includes a control circuit 302 coupled to interface 216 and including an output coupled to a driver 304 for driving one or more LEDs 218, which emit light toward optical sensors 222. Trigger shoe 116, safety mechanism 226, and other components 228 may block at least some of the emitted light, allowing optical sensors 222 to receive at least some of the emitted light and to produce electrical signals proportional to the received light. Optical sensors 222 provide the signals to ADCs 306, which convert the signals into one or more digital values that are provided to a state detector 308, which has an output coupled to control circuit 302.

In this example, driver 304, ADCs 306, and state detector 308 are moved from electronic device 204 into trigger mechanism 102. In this example, control circuit 302 can control operation of trigger assembly 102 based on the state determined by state detector 308 and/or in response to signals received from electronic device 204 via interface 216.

While the example of FIG. 2 depicted an MCU 208 for controlling operation of the drivers 210 and for receiving data from state detector 214 and/or from ADCs 212, MCU 208 can include a programmable processor configured to execute instructions that, when executed, cause the processor to determine a state of various components of trigger assembly 102. One example of such a programmable processor implementation is described below with respect to FIG. 4.

Figure 4:
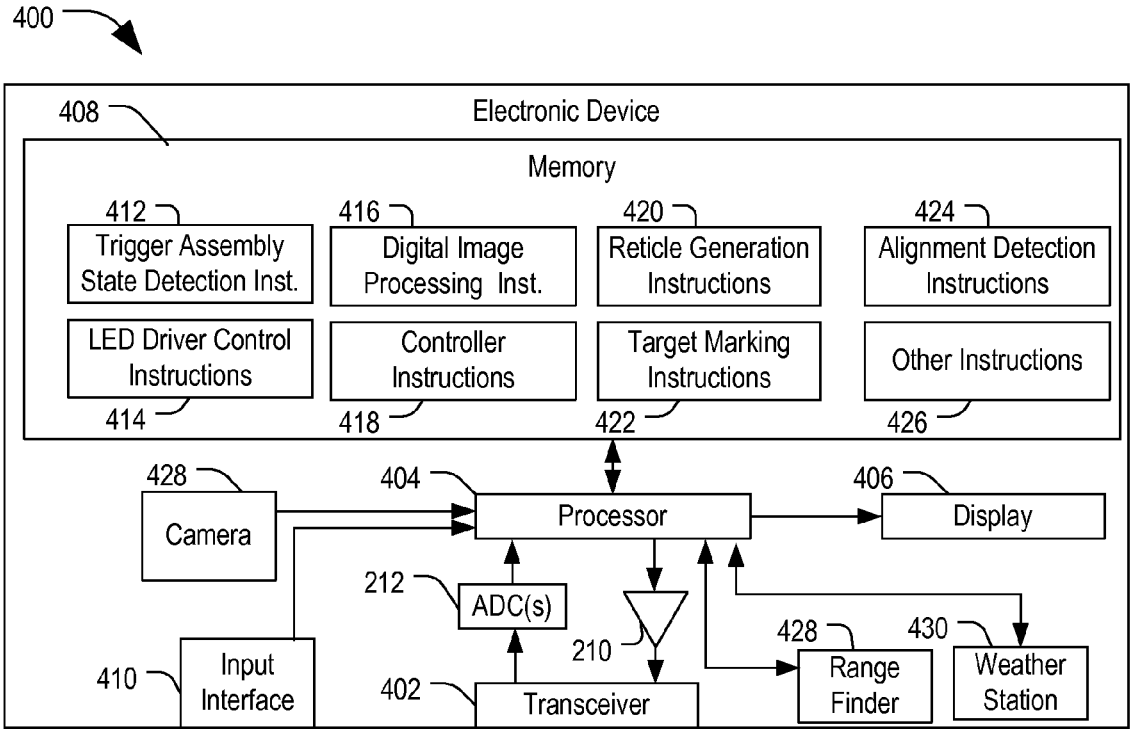
FIG. 4 is a block diagram of a second embodiment of an electronic device including driver circuitry and analog-to-digital converter circuitry for communicating with the optical detection circuitry of the trigger assembly of FIG. 2.

FIG. 4 is a block diagram of a second embodiment of an electronic device 400 including drivers 210 and ADCs 212 for communicating with the optical detection circuitry of the trigger assembly of FIG. 2. Electronic device 400 includes a transceiver 402, which can be implemented as an interface having pads or terminals configured to couple to trigger assembly 102 via wires. Transceiver 402 includes inputs coupled to outputs of drivers 210 for receiving an LED driver signal. Drivers 210 include inputs coupled to processor 404. Processor 404 is coupled to a display 406 for displaying data, a camera 428 for capturing image data, and an input interface 410 for receiving user input. Processor 404 further includes an input coupled to a range finder 428, which may utilize a laser to determine a distance, and to a weather station 430, which can be used to detect ambient conditions, including temperature, humidity, wind speed and direction, and other environmental conditions. Processor 404 is also coupled to ADCs 212, which have inputs coupled to transceiver 402 and outputs coupled to processor 404. Processor 404 is further coupled to a memory 408, which stores data and processor-executable instructions.

Memory 408 includes LED driver control instructions 414 that, when executed, cause processor 404 to control drivers 210 to drive LEDs within trigger assembly 102. Memory 408 further includes trigger assembly state detection instructions 412 that, when executed, cause processor 404 to determine a state of trigger assembly 102 as a function of the values at the outputs of ADCs 212. Memory 408 further stores digital image processing instructions 416 that, when executed, cause processor 404 to operate as an image processing device to process pixel data captured by camera 428. Memory 408 also stores reticle generation instructions 420 that, when executed, cause processor 404 to produce a digital representation of a reticle (calibrated to the small arms firearm) and to display the digital reticle within the digital view area.

Memory 408 further includes target marking instructions 422 that, when executed, cause processor 404 to receive user input to assign a digital marker onto an object within the digital view area. In a hunting application, the user may interact with input interface 410 (which may include one or more buttons) to apply a digital marker onto a target (such as a deer) that is within the digital view area. Digital image processing instructions 416 can isolate the portion of the digital view area that corresponds to the target having the digital marker so that the digital marker can move with the target as the target moves through the view area captured by camera 428. Memory 408 includes alignment detection instructions 424 that, when executed, cause processor 404 to determine a difference between cross-hairs of the digital reticle from the digital marker.

Figure 5:
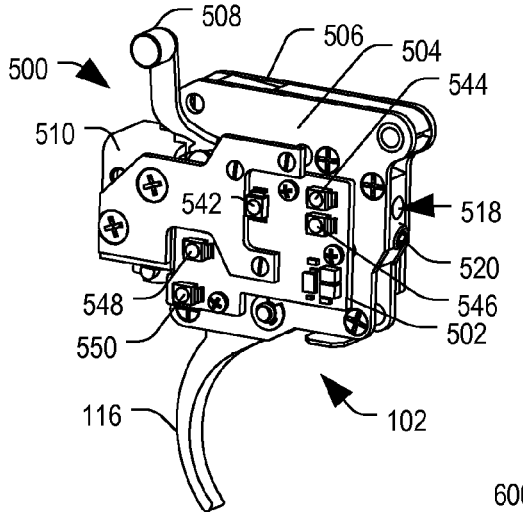
FIG. 5 is a perspective view of an embodiment of a right side of the trigger assembly of FIGS. 2 and 3.
Figure 6:
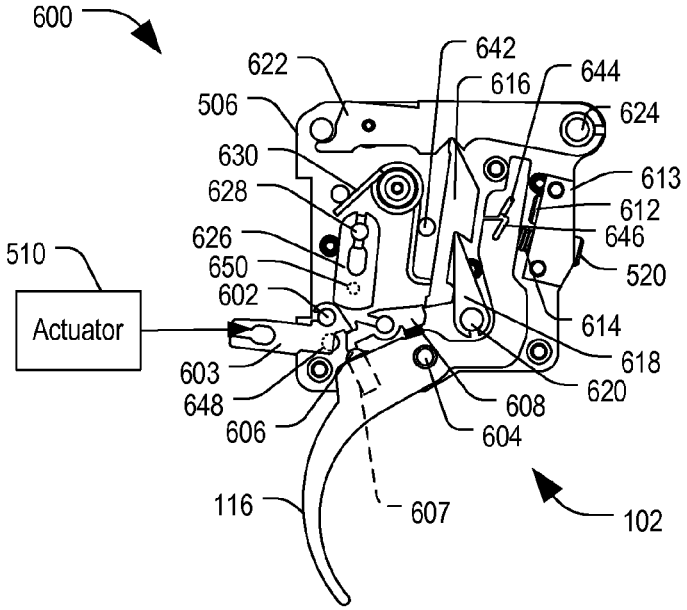
FIG. 6 is a side view of the internal components of the trigger assembly of FIG. 5.

Memory 408 further includes controller instructions 418 that, when executed, cause processor 404 to control, for example, an actuator within trigger mechanism 102 (such as actuator 510 depicted in FIGS. 5 and 6). In particular, if the difference determined using alignment detection instructions 424 is less than a threshold difference, controller instructions 418 cause processor 404 to generate a control signal to adjust the actuator to release a blocking mechanism to allow the small arms firearm to be discharged. If the difference is greater than the threshold, controller instructions 418 cause processor 404 to generate the control signal to prevent discharge. Memory 408 may also include other instructions 426, such as upgrade instructions, user configuration instructions, and so on. Further, memory 408 may store ballistics data, calibration data, user settings, and/or other information.

FIG. 5 is a perspective view 500 of an embodiment of a right side of the trigger assembly 102 of FIGS. 1 and 2. Trigger assembly 102 includes a PCB 502 that includes circuitry, such as LEDs 542, 544, 546, 548, and 550, and other circuitry, such as drivers for driving signals to cause LEDs 542, 544, 546, 548, and 550 to emit light. PCB 502 may also include at least a portion of interface 216 in FIG. 2. PCB 502 is also coupled to an actuator 510, which is part of a blocking mechanism configured to selectively delay or prevent disengagement of the firing mechanism. In an alternative example, actuator 510 may be replaced with a solenoid or another electrically controllable transducer configured to prevent disengagement of the firing mechanism. Trigger assembly 102 includes side plates 504 and 506 and a safety engagement lever 508 that engages a safety mechanism between side plates to prevent disengagement of the firing mechanism. Trigger assembly 102 further includes an opening 518 for a trigger stop adjustment and a spring force adjustment element 520, which can allow for adjustment of the trigger pull resistance and stop position.

In this example, LEDs 544 and 546 emit light through openings in a portion of trigger shoe 116 that extends between PCB 502 and a corresponding circuit board (PCB 702 in FIG. 7) on the other side of trigger assembly 102. Such openings define light paths through which the emitted light of LEDs 542, 544, 546, 548, and 550 may pass, provided that a component of trigger assembly 102 does not interfere with or otherwise block the light path. Corresponding receivers on PCB 702 receive such emitted light that is not obstructed or blocked by trigger shoe 116. LEDs 542 and 548 emit light through openings in a substrate within trigger assembly 102 that are positioned to correspond to engaged and disengaged positions of a safety lever (safety lever 626 in FIG. 6). LED 550 corresponds to a location associated with a blocking lever (blocking lever 603 in FIG. 6) that is movable by actuator 510 in response to a control signal to prevent discharge of the firing mechanism.

In operation, control signals from electronic device 204 are received by a transceiver on PCB 502 and are provided to one or more of LEDs 542, 544, 546, 548, and 550 to cause them to emit light through corresponding openings toward optical sensors or receivers on the corresponding PCB on the opposing side of trigger assembly 102. Optical sensors on the corresponding PCB receive emitted light, and the pattern of received light versus blocked light can be used to determine the state of the trigger shoe 116, safety lever 626, and blocking lever 603, for example. Depending on the position of LEDs and corresponding openings, the position of other components may also be determined. In an example, the position of the safety lever 626 can be determined and a controller can send a control signal to actuator 510 to position blocking lever 603 to prevent disengagement of the firing mechanism to assist the safety lever 626, providing a secondary safety mechanism in the event the safety mechanism is not fully engaged. An example of the trigger assembly 102 with the side plate 504 removed showing the blocking lever is described below with respect to FIG. 6.

FIG. 6 is a side view 600 of the trigger assembly 102 of FIG. 5. Trigger assembly 102 includes trigger shoe 116 configured to move about an axis 604 in response to force applied by a user, causing a spring plunger 606 recessed in a bore 607 within trigger shoe 116 to contact a sear lever 608 at a contact location. Sear lever 608 contacts a proximal end of a lever 616 at a sear location. A distal end of lever 616 contacts a striker block 622. Lever 618 is configured to pivot about an axis 620 and to contact lever 616 to secure lever 616 against striker block 622. Trigger assembly 102 includes a trigger block 613 including the spring force adjustment element 520 for adjusting a pull force spring 614 and a trigger stop 612.

Trigger assembly 102 further includes striker block 622 configured to pivot about an axis 624 and to engage lever 616. Trigger assembly 102 includes a lever return spring 630 configured to return lever 616 to a firing position. Trigger assembly 102 also includes a safety lever 626 configured to pivot about an axis 628 and to couple to safety engagement lever 508. When engaged, safety lever 626 contacts lever 616 to prevent release of striker block 622.

Trigger assembly 102 further includes blocking lever 603 configured to pivot about axis 602 and to contact sear lever 608 when engaged by actuator 510. In an example, actuator 510 is responsive to control signals from electronic device 204 to selectively move blocking lever 603 into or out of contact with sear lever 608 to selectively prevent or allow disengagement of the firing mechanism (e.g., movement of lever 616 to disengage striker block 622.

Trigger assembly 102 includes openings 642, 644, 646, 648, and (not shown, behind Safety Lever 626), which correspond to LEDs 542, 544, 546, 548, and 550 (in FIG. 5) and optical sensors 742, 744, 746, 748, and 750 (in FIG. 7), respectively. Openings 642 and (not shown, behind Safety Lever 626) correspond to LEDs 542 and 550 and optical sensors 742 and 750 to detect a position of safety lever 626. Openings 644 and 646 correspond to LEDs 544 and 546 and optical sensors 744 and 746 to detect a position of trigger shoe 116. Optical sensor 648 corresponds to LED 548 and to optical sensor 748 to detect a position of blocking lever 603.

In an example, trigger shoe 116 is movable in response to force applied by the user. Spring plunger 606 applies a force proportional to the pressure applied by the user up to a limit set by the spring force of spring plunger 606. Trigger stop 612 prevents the trigger shoe 116 from advancing far enough to physically contact sear lever 608, allowing spring plunger 606 to supply the force to disengage lever 616. Before the force is applied to trigger shoe 116, LED 544 emits light through opening 644 and trigger shoe 116 blocks light from LED 546. When force is applied to trigger shoe 116, trigger shoe 116 moves allowing emitted light from LEDs 544 and 546 through openings 644 and 646. When trigger shoe 116 reaches its end stop position, LED 546 emits light through opening 646 and trigger shoe 116 blocks light from LED 544. In an alternative embodiment, the relative positions of openings 644 and 646 may be adjusted such that emitted light initially passes only through opening 646, then through both openings 644 and 646, and then only through opening 644.

In another example, safety lever 626 is movable about axis 628 in response to force applied by a user to safety engagement lever 508. In this instance, LEDs 542 and 548 emit light through corresponding openings 642 and (not shown, behind Safety Lever 626). Safety lever 626 is depicted in the "OFF" position, blocking light from LED 548 so that is does not reach detector 750. Light from LEDs 542 and 548 passes through opening 642 (not shown, behind Safety Lever 626). In a safety "ON" state, safety lever 626 blocks opening 642, and in a safety "OFF" state, safety lever 626 blocks the opening that is hidden behind Safety Lever 626. In the intermediate state, a controller within electronic device 204 or within trigger assembly 102 can control actuator 510 to engage blocking lever 603 to prevent disengagement of the firing mechanism until the safety lever 626 is in a fully "ON" or "OFF" state.

Figure 7:
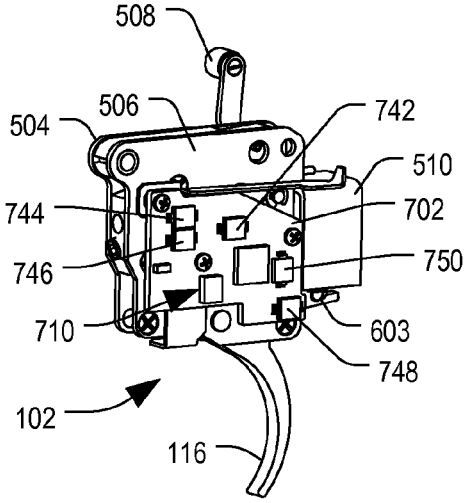
FIG. 7 is a perspective view of a left side of the trigger assembly of FIG. 5.

FIG. 7 is a perspective view 700 of a left side of the trigger assembly 102 of FIG. 5. Trigger assembly 102 includes plates 504 and 506 and a PCB 702 including at least a portion of interface 216, which is coupled to actuator 510. Actuator 510 is configured to selectively move blocking lever 603 to engage sear lever 608 to prevent discharge of the firearm, for example. PCB 702 further includes a transceiver 710, which is configured to encode digital signals for communication of signals relating to the state of trigger mechanism 102. PCB 702 also includes optical sensors 742, 744, 746, 748, and 750, which correspond to openings 642, 644, 646, 648, and 650 (shown in phantom behind Safety Lever 626) (in FIG. 6) and to LEDs 542, 544, 546, 548, and 550 (in FIG. 5).

In an example, optical sensors 742, 744, 746, 748, and 750 are configured to receive emitted light through openings 642, 644, 646, 648, and 650 (shown in phantom behind Safety Lever 626). Each of the optical sensors 742, 744, 746, 748, and 750 is configured to produce an electrical signal proportional to the received light. When light is received through an opening, each of optical sensors 742, 744, 746, 748, and 750 is configured to produce a logical "1" value, and when light is blocked, each is configured to produce a logical "0" value. The logical values can be used to determine the state of components within trigger mechanism 102, as described above.

In some instances, the values produced by optical sensors 742, 744, 746, 748, and 750 can be used to determine the state of components within trigger assembly 102, which state information can be used by a controller (either within electronic device 204 or within trigger mechanism 102 itself) to control operation of trigger assembly 102. In one instance, the controller can selectively control actuator to move blocking lever 603 into a position to prevent disengagement of the firing mechanism when the state of safety lever 626 is indeterminate (i.e., between "ON" and "OFF" states). In another instance, the controller can trigger operation of another circuit in response to detecting movement of trigger shoe 116 based on changes in the optical signals received by optical sensors 744 and 746. In an example, the controller may trigger processor 404 to execute alignment detection instructions 424 in response to movement of trigger shoe 116, and processor 404 may execute controller instructions 418 to control actuator 510 to prevent disengagement of the firing mechanism until a target is aligned with a reticle within a threshold distance. In still another instance, controller can trigger operation of camera 428 to begin recording a video stream. Other operations may also be triggered based on detection of movement of trigger shoe 116.

While above-examples describe some control operations that may be activated or deactivated based on the state of components of trigger assembly 102, including a secondary safety mechanism, video camera functionality, tracking/alignment functionality, and so on, other functionality may also be activated. In an example, an error detection function may be triggered when components fail to reach their expected position within a period of time, which may be used to alert a user. In one instance, an LED on a peripheral edge of trigger mechanism 102 may be activated to emit light or to flash to alert the user that the safety mechanism is neither fully engaged nor disengaged. Other circuitry may also be included that can be used to provide indications to the user and/or to control operation of trigger mechanism 102 to prevent disengagement of the firing mechanism when the state of particular components is indeterminate (i.e., between known states).

In conjunction with the systems and trigger assemblies described above with respect to FIGS. 1-7, a trigger assembly includes a pair of PCBs on opposing sides of a portion of a trigger shoe and other components. One of the PCBs includes LEDs to emit light and the other includes optical receivers or sensors to receive the emitted light and to produce electrical signals proportional to the received light. Control circuitry on one of the PCBs or within an electronic device coupled to one of the PCBs utilizes the electrical signals to determine a state of one or more components of the trigger assembly. In some instances, the control circuitry utilizes the determined state information to control one or more elements of the trigger assembly. In other instances, the control circuitry controls one or more components, such as LEDs, cameras, and other circuits in response to determining the state.

While the above-discussion has largely assumed that a single type of sensing mechanism, such as an optical sensing configuration using LEDs and optical sensors, is used within a single trigger assembly, it should be appreciated that multiple types of sensors may be used in a given trigger assembly. In an example, optical sensors and proximity sensors may be employed in a particular trigger assembly. In general, a particular trigger assembly can include optical sensors, reed switches, laser sensors, proximity sensors, capacitive sensors, direct contact sensors, Hall effect sensors, or any combination thereof.

Additionally, while the above-discussion discussed utilizing the trigger assembly in connection with a rifle, it should be understood that the trigger assembly can be used with a pistol, an airsoft gun, a paintball gun, a crossbow, or any type of firing system that utilizes a trigger to disengage the firing mechanism.

Although the present invention has been described with reference to preferred embodiments, workers skilled in the art will recognize that changes may be made in form and detail without departing from the scope of the invention.

What is claimed is:

1. A trigger assembly comprising:

a plurality of components including a trigger shoe configured to disengage a firing mechanism in response to a force applied by a user and including a safety mechanism, the trigger shoe including at least one opening to allow light to pass therethrough and the safety mechanism including a safety lever configured to move between a first position and a second position;

a first circuit including at least one optical sensor including a first optical sensor adjacent to the at least one opening to receive light and including a second optical sensor adjacent to the safety mechanism; and a controller configured to determine a positional state of the trigger shoe in response to a signal from the first optical sensor and a physical state of the safety mechanism in response to a signal from the second optical sensor indicating a position of the safety lever, the controller further configured to prevent the trigger shoe from disengaging the firing mechanism when the safety mechanism is in a safety on state and when the safety mechanism is between the safety on state and a safety off state as determined based on the signal from the second optical sensor.

2. The trigger assembly of claim 1, wherein the at least one optical sensor is configured to generate an electrical signal proportional to light received by the optical sensor.

3. The trigger assembly of claim 1, further comprising a second circuit on a side of the plurality of components opposite that of the first circuit, the second circuit including at least one light emitting diode (LED) configured to emit light toward the first circuit.

4. The trigger assembly of claim 3, wherein the at least one opening of the trigger shoe comprises:

a first opening; and a second opening;

wherein the at least one LED includes a first LED adjacent to the first opening and a second LED adjacent to the second opening on the side opposite that of the first circuit; and wherein the at least one optical sensor includes a first trigger optical sensor adjacent to the first opening and a second trigger optical sensor adjacent to the second opening to receive first and second light emitted from the first and second LEDs, respectively.

5. The trigger assembly of claim 4, wherein the first circuit further comprises a control circuit configured to determine the positional state of the trigger shoe in response to receiving at least one of the first and second light.

6. The trigger assembly of claim 4, further comprising an interface configurable to couple to an electronic device that is external to the trigger assembly and to communicate electrical signals proportional to at least one of the first and second light received by the first and second trigger optical sensors to the electronic device.

7. The trigger assembly of claim 3, the second circuit further including a second LED configured to emit light toward the second optical sensor, the light from the second LED traversing an opening corresponding to a possible position of the safety mechanism unless blocked by a portion of the safety mechanism.

8. The trigger assembly of claim 1, wherein the safety mechanism further includes a blocking lever and a solenoid coupled to the blocking lever; and wherein the controller activates the solenoid to engage the blocking lever to prevent the trigger shoe from disengaging the firing mechanism.

9. A trigger assembly comprising:

a trigger mechanism having a first side and a second side, the trigger mechanism including a trigger shoe having at least one opening extending through the trigger shoe, the trigger mechanism configured to disengage a firing mechanism in response to a force applied to the trigger shoe, the trigger mechanism further including a safety mechanism;

a first printed circuit board (PCB) adjacent to the first side and including a plurality of light-emitting diodes (LEDs) configured to emit light through the at least one opening of the trigger shoe and to emit light proximate to the safety mechanism toward the second side;

a second PCB adjacent to the second side positioned opposite to the first PCB and including a plurality of optical sensors corresponding to the plurality of LEDs, each of the plurality of optical sensors positioned opposite to a respective one of the plurality of LEDs and configured to produce an electrical signal proportional to light received from the respective one of the plurality of LEDs, light from one of the plurality of LEDs traverses an opening corresponding to a possible position of the safety mechanism unless blocked by a portion of the safety mechanism; and a controller configured to determine a state of the trigger mechanism and a physical state corresponding to the safety mechanism based on electrical signals from the plurality of optical sensors, the controller configured to prevent disengagement of the firing mechanism when the physical state of the safety mechanism is in a safety on state and when the safety mechanism is in a transitional state between the safety on state and a safety off state.

10. The trigger assembly of claim 9, wherein the second PCB includes the controller.

11. The trigger assembly of claim 9, wherein the first PCB comprises one or more LED drivers configured to control the plurality of LEDs.

12. The trigger assembly of claim 9, wherein:

the second PCB comprises one or more analog-to-digital converters (ADCs) to convert the electrical signals into digital values; and the controller determines the state in response to the digital values.

13. The trigger assembly of claim 9, wherein the trigger mechanism further comprises:

a trigger shoe extending at least partially between the first and second PCBs; and wherein the state of the trigger mechanism comprises a position of a trigger shoe relative to a light path between at least one of the plurality of LEDs and corresponding to at least one of the plurality of optical sensors.

14. The trigger assembly of claim 9, wherein the trigger mechanism further comprises:

a safety lever configurable by a user to selectively prevent disengagement of the firing mechanism; and wherein the physical state of the safety mechanism comprises a position of the safety lever relative to a light path between at least one of the plurality of LEDs and corresponding to at least one of the plurality of optical sensors.

15. A trigger assembly comprising:

a trigger mechanism including a safety mechanism;

a trigger shoe having at least one opening;

a first circuit including a first sensor proximate to the safety mechanism and a second sensor proximate to the trigger shoe, the first circuit configured to generate a first signal proportional to received light, the first circuit further including a controller coupled to the first sensor and configured to determine a physical state of the safety mechanism in response to the first signal, the second sensor configured to provide a second signal proportional to received light to the controller, and the controller is further configured to determine a state of the trigger shoe in response to the second signal and to selectively prevent disengagement of a firing mechanism of the trigger mechanism in response to determining the physical state; and a second circuit positioned opposite the first circuit and configured to emit light toward the sensor through an opening corresponding to a possible position of the safety mechanism unless blocked by a portion of the safety mechanism.

16. The trigger assembly of claim 15, further comprising the controller configured to selectively engage a blocking lever of the safety mechanism when the physical state corresponds to one of a safety on state and a transitional state between the safety on state and a safety off state.

17. The trigger assembly of claim 16, further comprising the first circuit configured to communicate an alert to the second circuit indicating that the safety mechanism is in one of the safety on state and the transitional state in response to determining the state.

* * * * *